US009816336B2

(12) United States Patent
Bernard

(10) Patent No.: US 9,816,336 B2
(45) Date of Patent: Nov. 14, 2017

(54) REAL TIME CONFORMANCE

(71) Applicant: Halliburton Energy Services, Inc, Houston, TX (US)

(72) Inventor: Christopher J. Bernard, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/300,197

(22) PCT Filed: Jul. 8, 2015

(86) PCT No.: PCT/US2015/039544

§ 371 (c)(1),
(2) Date: Sep. 28, 2016

(87) PCT Pub. No.: WO2016/007618

PCT Pub. Date: Jan. 14, 2016

(65) Prior Publication Data

US 2017/0183926 A1 Jun. 29, 2017

Related U.S. Application Data

(60) Provisional application No. 62/022,040, filed on Jul. 8, 2014.

(51) Int. Cl.
*E21B 21/08* (2006.01)
*E21B 33/12* (2006.01)
(Continued)

(52) U.S. Cl.
CPC ..... *E21B 21/08* (2013.01); *E21B 33/12* (2013.01); *E21B 49/08* (2013.01); *E21B 2021/006* (2013.01)

(58) Field of Classification Search
CPC ..... E21B 21/08; E21B 33/12; E21B 49/08; E21B 2021/006
See application file for complete search history.

(56) References Cited

U.S. PATENT DOCUMENTS 5,335,732 A 8/1994 McIntyre
9,316,054 B2 * 4/2016 Weinstock ..... E21B 7/12
(Continued)

FOREIGN PATENT DOCUMENTS

WO WO 2008/109693 A2 9/2008

OTHER PUBLICATIONS

International Search Report and the Written Opinion of the International Search Authority, or the Declaration, dated Sep. 14, 2015, PCT/US2015/039544, 9 pages, ISA/KR.

*Primary Examiner* — Yong-Suk (Philip) Ro

(57) ABSTRACT

Methods and systems for identifying and sealing a water zone in a formation employ underbalanced drilling techniques and injection of a conformance fluid into a wellbore drilled thereby. A return wellbore fluid is monitored in real-time utilizing a fluid analysis system in fluid communication with return wellbore fluids in order to identify the water zone in the formation. When the water zone is identified, drilling is suspended, and the wellbore may be brought to a slightly overbalanced condition. A barrier fluid pill is injected into the wellbore via a drillstring. Immediately following the barrier fluid pill injection, a conformance fluid is injected, "chasing the barrier fluid pill". Pressures in the drillstring and the wellbore annulus are controlled in order to position the pill. The pill functions as a barrier to contain and assist injection of the conformance fluid into the water zone, thereby sealing the water zone.

20 Claims, 5 Drawing Sheets

(51) Int. Cl.
*E21B 49/08* (2006.01)
*E21B 21/00* (2006.01)

(56) References Cited

U.S. PATENT DOCUMENTS

| | | | | |
|---|---|---|---|---|
| 2004/0094299 | A1* | 5/2004 | Jones | E21B 33/12 166/285 |
| 2009/0050374 | A1 | 2/2009 | Spiecker et al. | |
| 2011/0056681 | A1 | 3/2011 | Khan | |
| 2013/0306314 | A1 | 11/2013 | Curtice | |

* cited by examiner

REAL TIME CONFORMANCE

CROSS-REFERENCE TO RELATED APPLICATIONS

This application is a U.S. National Stage patent application of International Patent Application No. PCT/US2015/039544, filed on Jul. 8, 2015, which claims priority to U.S. Provisional Application No. 62/022,040 filed Jul. 8, 2014, both entitled "Real Time Conformance" and the disclosures of which are hereby incorporated by reference in their entirety.

BACKGROUND

1. Field of the Invention

The present disclosure generally relates to the identification and treatment of wellbore formation fluid zones and, more particularly, to real-time identification of water zones in wells being drilled in an underbalanced state and the treatment of such water zones.

2. Background

In underbalanced drilling, the pressure of the wellbore annulus is typically less than the pressure of the geologic formation in which the wellbore is drilled. As such, in underbalanced drilling, formation fluids move into the wellbore and are recovered in real-time along with drilling fluids, such as mud, utilized to drill the wellbore. To the extent these recovered fluids are analyzed, they may be analyzed to identify and gather insight on hydrocarbon bearing zones so as to subsequently assist in facilities design and in the placement of a completion string. The completion string may include perforators, filter assemblies, flow control valves, downhole permanent gauges, hangers, packers, crossover assemblies, completion tools, and the like.

Once the completion string has been placed in a drilled wellbore, various techniques exist for addressing migration of water into the production tubing from water zones in the formation. It is well known that excessive water production from a formation during hydrocarbon recovery can greatly affect the economic life of a producing well. A variety of gelants, foams, precipitates, or other chemicals (collectively referred to as "conformance fluids") are used by the industry to plug these water zones in order to control water production. The conformance fluids are selectively placed by injection equipment or some other selectivity mechanism to ensure that oil or hydrocarbon-bearing zones are not damaged. This injection equipment or these selectivity mechanisms may be utilized in conjunction with the completion string or may require that the completion string be tripped out of the wellbore while the water zones are addressed.

In some instances, it may be beneficial to manage the movement of water into the wellbore prior to placing the completion string. For example, since additional costs are associated with safely storing or disposing of water recovered from the geologic formation, it may be desirable to plug the water zones as early in the wellbore operations as possible in order to minimize or manage these additional costs.

BRIEF DESCRIPTION OF THE DRAWINGS

The disclosure is described in detail hereinafter on the basis of embodiments represented in the accompanying figures, in which.

DETAILED DESCRIPTION

Figure 1:
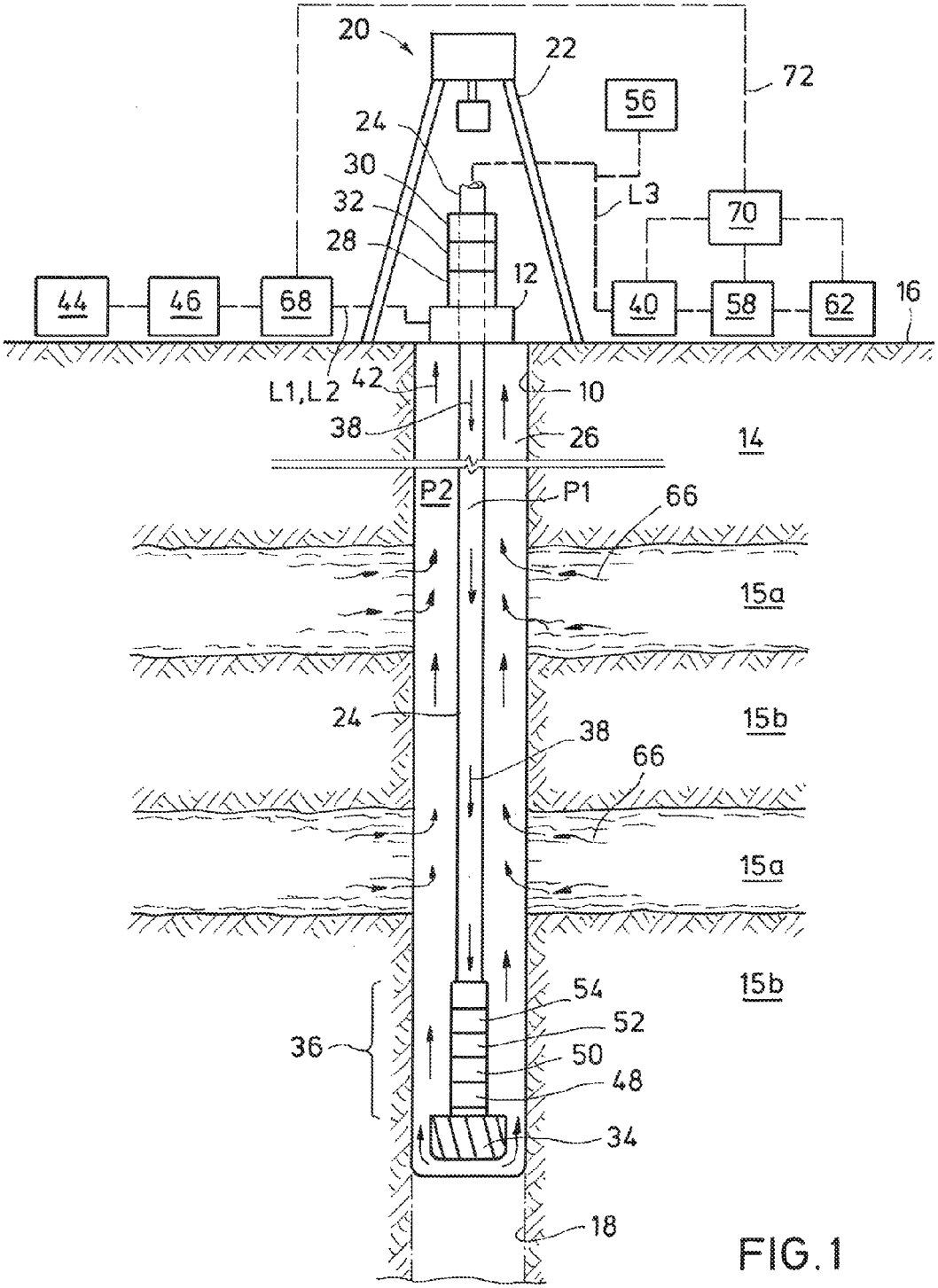
FIG. 1 is a partially cross-sectional schematic diagram of an underbalanced wellbore during drilling operations, with real time reservoir evaluation equipment in place to analyze recovered wellbore fluid for water content in accordance with one or more exemplary embodiments of the disclosure.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, up-hole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the up-hole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict an apparatus in a portion of a wellbore having a specific orientation, unless indicated otherwise, it should be understood by those skilled in the art that the apparatus according to the present disclosure may be equally well suited for use in wellbore portions having other orientations including vertical, slanted, horizontal, curved, etc. Likewise, unless otherwise noted, even though a Figure may depict an onshore or terrestrial operation, it should be understood by those skilled in the art that the apparatus according to the present disclosure is equally well suited for use in offshore operations. Further, unless otherwise noted, even though a Figure may depict a wellbore that is partially cased, it should be understood by those skilled in the art that the apparatus according to the present disclosure may be equally well suited for use in fully open-hole wellbores.

1. Description of Exemplary Embodiments

Identifying water production zones in a geologic formation extending along a wellbore may be achieved during underbalanced drilling operations by monitoring the recovered wellbore fluids in real-time. In some exemplary embodiments, upon the identification of a water zone, drilling is suspended and a barrier fluid in the form of a pill is pumped through the drillstring into the wellbore annulus with a conformance fluid chasing the barrier fluid pill. The barrier fluid pill operates to prevent passage of the conformance fluid therethrough, and is positioned in the wellbore annulus slightly above the identified water zone by controlling the annulus pressure above the barrier fluid pill and the drillstring pressure. Surface back-pressure may then be applied by bull heading down the wellbore annulus and by slowly pumping down the drillstring. It is envisioned that the back-pressure will force the conformance fluid into the water zone. The conformance fluid may then be permitted to set within the water zone, thereby plugging the identified water zone. Thereafter, the barrier fluid pill may be sheared by reducing the annulus pressure and allowing circulation to resume through the barrier pill to the surface, after which, drilling can be resumed.

Referring initially to FIG. 1, a wellbore 10 extends from a wellhead 12 into a geologic formation 14 from the surface 16 of formation 14. Formation 14 is illustrated as having various formation fluid zones 15, such as water zones 15*a* and hydrocarbon zones 15*b*. Wellbore 10 is shown in the process of being drilled along a desired path 18. As illustrated, the desired path 18 is generally vertical. In one or more other exemplary embodiments, the desired path 18 includes a wide variety of vertical, directional, deviated, slanted and/or horizontal portions therein, and may extend along any trajectory through the formation 14.

Figure 3:
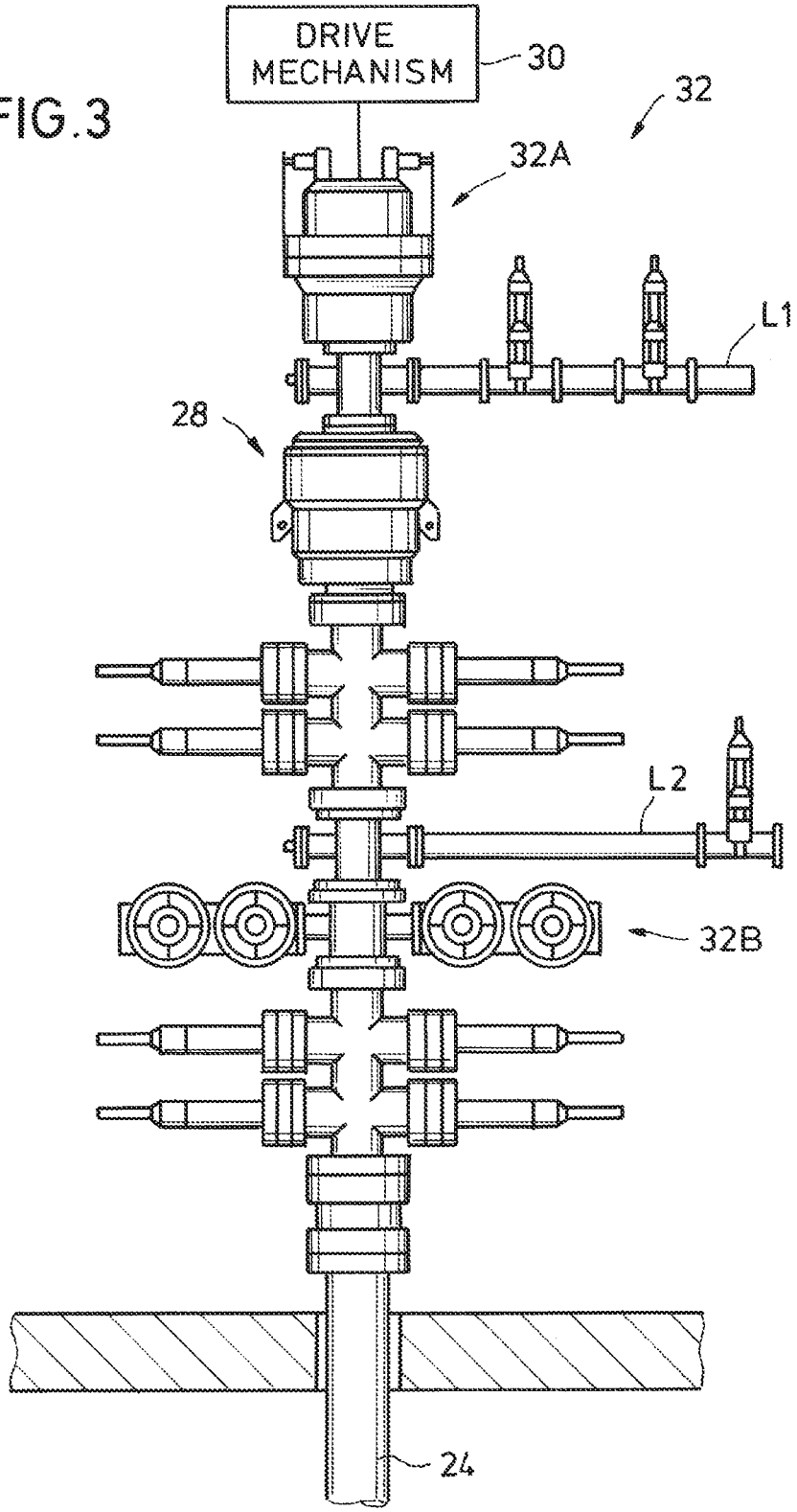
FIG. 3 is a schematic diagram illustrating a portion of an underbalanced drilling system that utilizes drill pipe as a drillstring in accordance with one or more exemplary embodiments of the disclosure.
Figure 4:
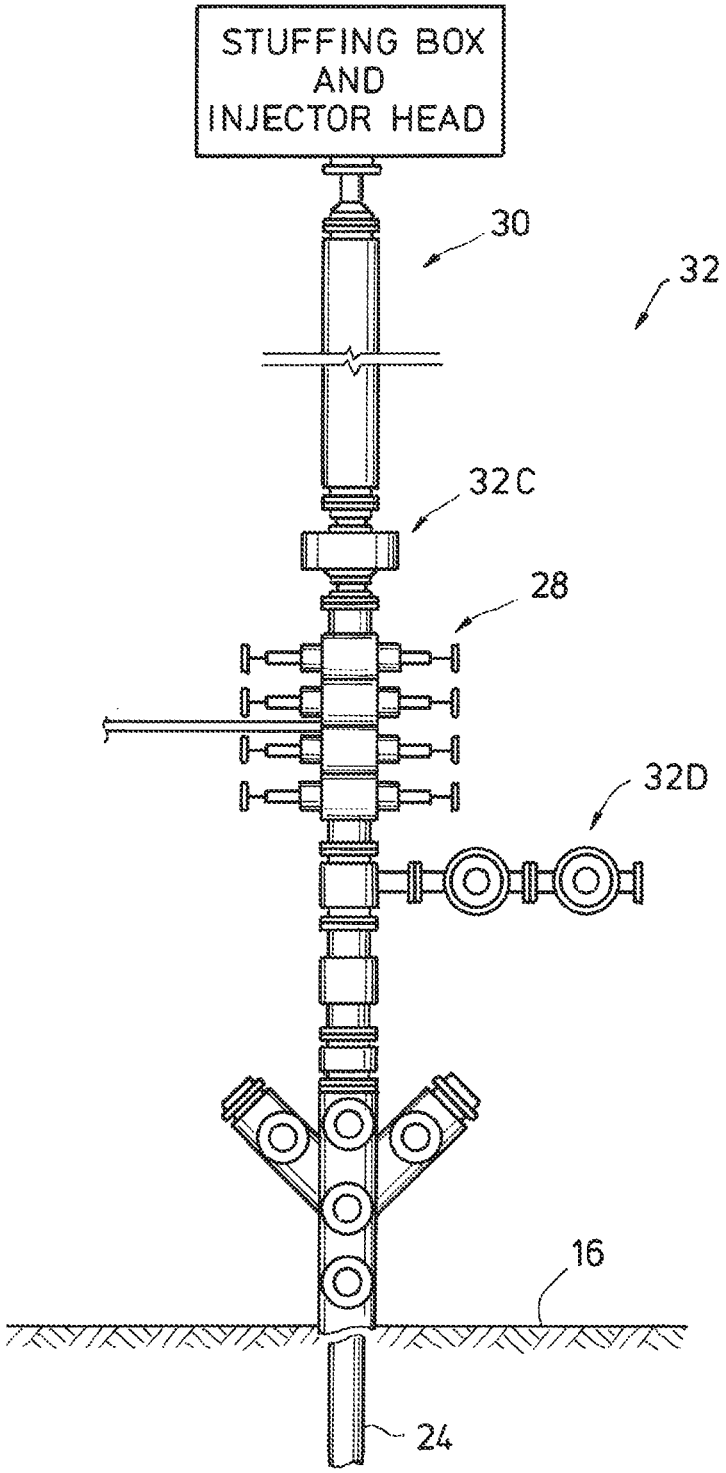
FIG. 4 is a schematic diagram illustrating a portion of an underbalanced drilling system that utilizing coiled tubing as the drillstring in accordance with one or more other exemplary embodiments of the disclosure.

A drilling system 20 is generally shown associated with wellbore 10. Drilling system 20 includes a drilling rig 22 positioned over formation 14 and disposed to deliver a drillstring 24, such as drill pipe (see FIG. 3), coiled tubing (see FIG. 4) or other conveyance mechanism, into wellbore 10. Drilling rig 22 may be located proximate to well head 12 or removed from the wellhead 12 (as is common in marine offshore or applications). An annulus 26 is formed between the exterior of drillstring 24 and the inside diameter of a wellbore 10. One or more blowout preventers (BOPs) 28 may also be provided at well head 12 and/or adjacent drilling rig 22. BOP 28 may include, alone or in combination, ram type blowout preventers, such as pipe rams, blind rams, shear rams, slip rams and variable rams, as well as annular blowout preventers. In some embodiments, at least one annular blowout preventer is stacked above several ram type blowout preventers. Adjacent drilling rig 22 above BOP 28 is a drive mechanism 30 used to drive drillstring 24 and a pressure control mechanism 32 to control pressure in annulus 26 during underbalanced drilling operations.

The lower end of drillstring 24 carries at a distal end a drill bit 34, and may also include a bottom hole assembly ("BHA") 36 carried above drill bit 34. Drilling fluid 38 having a drillstring pressure P1 may be pumped from a tank 40 to the upper end of drillstring 24. The drilling fluid 38 then flows through drillstring 24, through BHA 36, and exits from drill bit 34. At the bottom end of wellbore 10, drilling fluid 38 may mix with formation cuttings and downhole formation fluids, such as water and hydrocarbons forming a return wellbore fluid such as return drilling fluid mixture 42. The return drilling fluid mixture 42 then flows upwardly through annulus 26 to return formation cuttings and wellbore fluids to the surface 16. The return drilling fluid mixture 42 stored in a tank 44. In some exemplary embodiments, various types of processing equipment 46, such as screens, filters and/or centrifuges, may be provided to remove formation cuttings and otherwise process return drilling fluid mixture 42 prior to storage in the tank 44. Primary and secondary output flowlines L1 and L2 are provided for receiving the return drilling fluid mixture 42 from the wellbore 10, and an input flowline L3 is provided for directing drilling fluid 38 into the wellbore. The primary, secondary and input flowlines L1, L2, L3 and other conduits formed between various equipment described herein may include various types of pipes, tube and/or hoses (illustrated schematically).

BHA 36 may also include a power module 48, such as a mud motor, a steering module 50, a control module 52, and one or more sensor and instrumentation modules 54. In one or more embodiments, sensor and instrumentation module 54 includes fluid cut sensors and/or instrumentation disposed to measure the proportional quantity of one or more components in the return drilling fluid mixture 42 within annulus 26. In one or more embodiments, such sensors and/or instrumentation measure one or more qualities or properties of water. In one or more embodiments, sensor and instrumentation module 54 comprises an integrated computational element sensor tuned or otherwise disposed to identify water in-situ within the return drilling fluid mixture 42 or other annulus fluid.

In the case where drillstring 24 is comprised of drill pipe (as illustrated, e.g., in FIG. 3), in one or more embodiments, drive mechanism 30 may be provided to rotate the drillstring 24 during rotary drilling. In this regard, drive mechanism 30 may include a rotary table, a rotary drive motor and other equipment associated with rotation of drillstring 24 within a wellbore 10. Alternatively, drive mechanism 30 may include a top drive (not explicitly shown) suspended by a traveling block and wire rope rigged from a crown block located in the top of the drilling rig 22. In any event, where drillstring 24 is comprised of drill pipe, in one or more embodiments, pressure control mechanism 32 may include a rotating control head system 32A positioned atop a BOP 28 and disposed to seal the around the drillstring 24 and permit rotation of the drillstring 24. Pressure control mechanism 32 may also include choke valves 32B which may be operated to control drillstring pressure P1 and/or an annulus pressure P2 in annulus 26 as drillstring 24 rotates.

In embodiments where drillstring 24 is comprised of coiled tubing (as illustrated, e.g., in FIG. 4), drive mechanism 30 may include a coiled tube injector positioned atop a BOP 28. In the case of coiled tubing, in one or more embodiments, pressure control mechanism 32 may include a stripper packer 32C or other type of sealing equipment to pack-off on coiled tubing as it is stripped in and out of the wellbore 10. Pressure control mechanism 32 may also include choke valves 32D which may be operated to control the flow of fluids into and/or out of the wellbore 10 to thereby control drillstring pressure P1 and annulus pressure P2 as appreciated by those skilled in the art.

With continued reference to FIG. 1, gas generation equipment 56 as is commonly utilized in underbalanced drilling operations may be provided to decrease hydrostatic head pressure P2 of the return drilling fluid mixture 42. Gas generation equipment 56 may include a source of gas, appropriate compressors, such as air compressors, $N_2$ generators, low-pressure booster compressors and/or high pressure booster compressors as well as a flow regulator and pressure regulator to control the amount of gas injected during the drilling process. Although the gas generation equipment 56 is illustrated as coupled to the drillstring 24, one skilled in the art will recognize that gas from the gas generation equipment 56 may be injected into the annulus 26 without traveling through the entire drillstring 24. A concentric casing (not shown) or other mechanism may be provided in to permit gas from the gas generation equipment 56 to be injected into the annulus 26 at any desired depth in the wellbore 10.

A barrier fluid pill source 58 is in fluid communication with the wellbore annulus 26 via the drillstring 24 and is provided to deploy a barrier fluid pill 60 (see FIG. 2) in wellbore 10 as described herein. The term "pill" as used herein refers to a batch of specialized fluid used to form a barrier fluid pill 60 (see FIG. 2) that prevents the passage of conformance fluid 64 (see FIG. 2) therethrough as described below. In addition to barrier fluid pill source 58, a conformance fluid source 62 in fluid communication with the wellbore annulus 26 via the drillstring 24 is provided to deploy the conformance fluid 64 (see FIG. 2) in wellbore 10 as described below. The term "conformance fluids" as used herein refers to any gelants, foams, precipitates, or other chemicals that can be deployed in wellbore 10 to partially or fully plug or seal walls of the wellbore 10 in water zones 15*a* in order to control the production of water 66. Valving well known in the art may be employed to selectively control flow of the barrier fluid pill 60, conformance fluids 64, drilling fluid 38 or mud, return drilling fluid mixture 42 and other drilling fluids into and out of the wellbore 10.

In addition to or as an alternative to one or more sensors in sensor and instrumentation module 54 disposed to measure one or more qualities or properties of water 66 within return drilling fluid mixture 42, a fluid analysis system 68 may be disposed at surface 16. The fluid analysis system 68 is disposed to sample return drilling fluid mixture 42 to identify or otherwise measure changes in the quantity, proportion or percentage of water 66 in return drilling fluid mixture 42. In some exemplary embodiments, the sensor and instrumentation module 54 and/or the fluid analysis system 68 initially operates to monitor mass balance changes to identify an influx of any fluid into the wellbore. When a fluid influx is identified, the return drilling fluid mixture can be evaluated to determine whether the influx included water. If the influx is found to include water at or greater than a threshold rate, the sensor and instrumentation module 54 and/or the fluid analysis system 68 may indicate that the conformance remediation should commence. Fluid analysis system 68 is located on site at drilling system 20 and is disposed to operate in real-time or near real-time in order to identify the presence of water zones 15*a* as the wellbore 10 is being drilled through the water zones 15*a*. Based on the results of the analysis provided by the fluid analysis system 68, a fluid management control system 70 may be disposed to commence the conformance remediation. For example, the fluid management control system 70 may be employed to inject a barrier fluid pill 60 (FIG. 2) and conformance fluids 64 (FIG. 2) as described below. In this regard, a feedback control loop 72 is provided so that fluid management control system 70 can direct fluids from barrier fluid pill source 58 and conformance fluid source 62 as described below.

Figure 2:
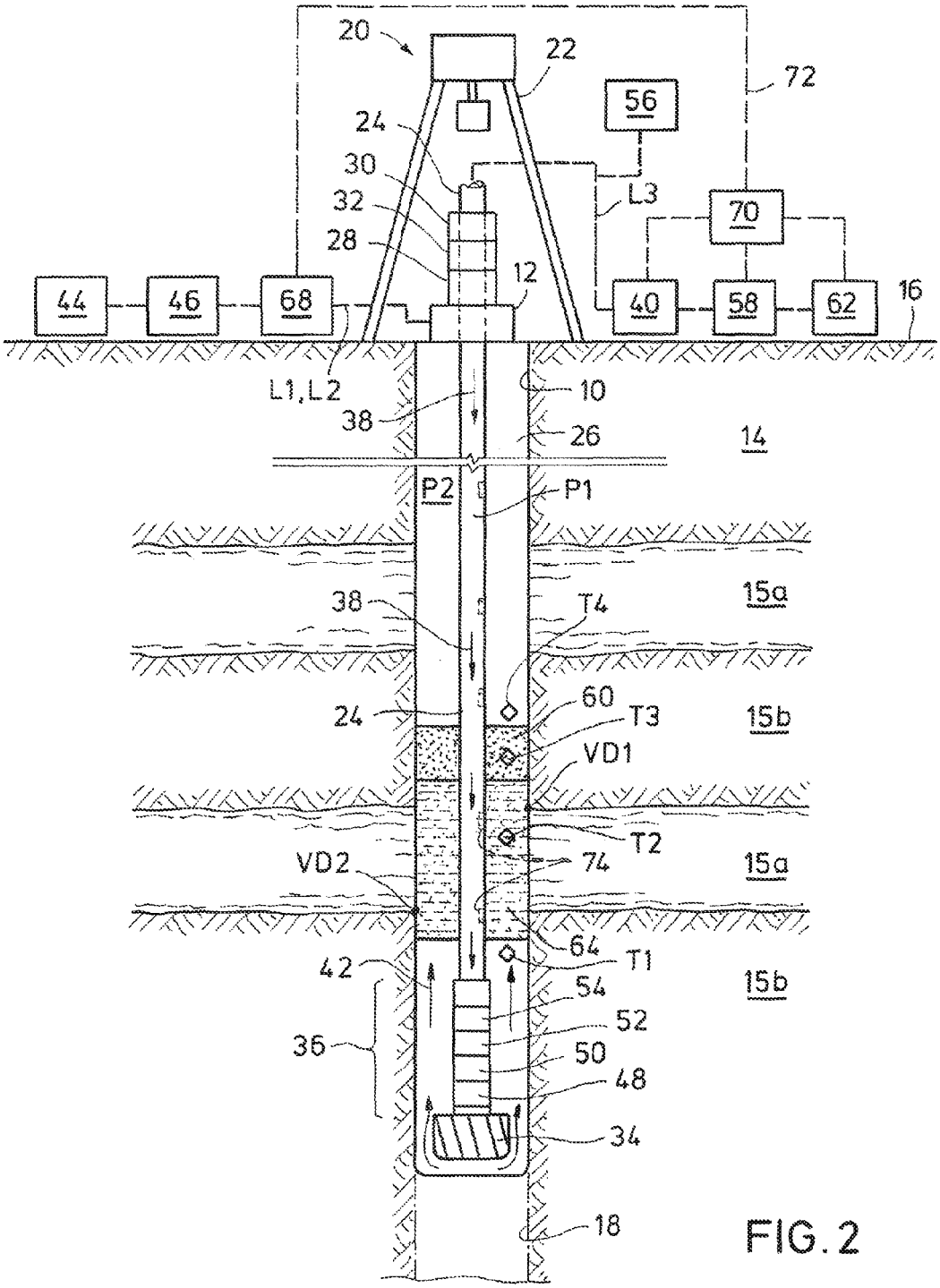
FIG. 2 is a partially cross-sectional schematic diagram of the underbalanced wellbore of FIG. 1 during drilling operations, illustrating a barrier fluid pill and a conformance fluid placed into the wellbore in order to force or inject the conformance fluid into a water zone defined in a geologic formation surrounding the wellbore to thereby seal the water zone.

Turning to FIG. 2, when an increase in water is detected in return drilling fluid mixture 42, signifying that a water zone 15*a* has been reached, a barrier fluid pill 60 is deployed in wellbore 10, followed by conformance fluid 64. In particular, upon identification of water zone 15*a*, a barrier fluid pill 60 is pumped from barrier fluid pill source 58 down drillstring 24 and into annulus 26. Immediately following barrier fluid pill 60, conformance fluid 64 is pumped from conformance fluid source 62 down drillstring 24 and into annulus 26. Persons of ordinary skill in the art will appreciate that during underbalanced drilling operations, pressure P2 in annulus 26 is typically maintained at a lower level than a pressure in the geologic formation 14. Hence formation fluids flow into the annulus 26 under the influence of the pressure in the formation 14, and are recovered during the drilling process. This is in contrast to overbalanced drilling operations, where the pressure P2 in the annulus 26 is typically maintained at a higher level than the pressure in the formation 14. In this regard, in one or more embodiments, upon identification of water zone 15*a*, drilling is suspended and the wellbore 10 is brought to an near balanced, e.g., slightly underbalanced, state or an overbalanced state to minimize the ingress of formation fluids from the formation 14 into the wellbore 10, and in particular, water from water zone 15*a*, prior to injection of the barrier fluid pill 60 and conformance fluid 64.

In any event, the barrier fluid pill 60 and conformance fluid 64 may be pumped into annulus 26 with the wellbore 10 in a near balanced state, and then the pressure P2 within annulus 26 is increased or controlled, and used to position fluid pill 60 and conformance fluid 64 within annulus 26. Specifically, pressure P2 may be gradually increased, e.g., with a choke or valve (not shown) in the output flow line(s) L1 or L2 (FIG. 1) or with choke valves 32B (FIG. 3), to slow the flow of return drilling fluid mixture 42, as well as barrier fluid pill 60 and conformance fluid 64. When it is determined that the barrier fluid pill 60 and conformance fluid 64 are at a desired position within annulus 26, annulus pressure P2 is equalized with drillstring pressure P1 in order to "balance" the fluid pressures in the wellbore 10 and stop the flow of fluid in wellbore 10. In this regard, the pressure P1 of drilling fluid 38, e.g., drilling mud in the drillstring 24 and in the annulus 26 below the conformance fluid 64, is equalized with the pressure P2 of drilling fluid, e.g., return drilling fluid mixture 42 in the annulus 26 above the barrier fluid pill 60. With the pressure P1 below the conformance fluid 64 balanced with pressure P2 above barrier fluid pill 60, the flow of fluids along the annulus 26 is temporarily suspended.

It will be appreciated that in one or more embodiments, return drilling fluid mixture 42 may be a analyzed (e.g., by sensor and instrumentation module 54 and/or by fluid analysis system 68) to determine the drillstring length, e.g., the vertical depth (VD), at which a water zone 15*a* begins, such as is illustrated by a first vertical depth $VD_1$. Specifically, an increase in the quantity, proportion or percentage of water 66 in the return drilling fluid mixture 42 may be observed in response to continued drilling past the first vertical depth $VD_1$ into the water zone 15*a*. Similarly, continued drilling and analysis of the return drilling fluid mixture 42 will likewise indicate the approximate VD at which the water zone 15*a* ends, such as is illustrated by a second vertical depth $VD_2$. Specifically, once the second $VD_2$ is reached, continued drilling will result in a decrease in the cut of water 66 in return drilling fluid mixture 42 as additional formation fluids such as hydrocarbons flow into annulus 26 and dilute the water 66.

Having determined the approximate location of a water zone 15*a*, drilling can be suspended and management of annulus pressure P2 can be utilized to control the flow of barrier fluid pill 60 and conformance fluid 64, and thereby position barrier fluid pill 60 to be just above the top of the water zone 15*a*. In other words, barrier fluid pill 60 is placed in the wellbore annulus 26 to be above the first vertical depth $VD_1$ so as to cause the conformance fluid 64 to overlay at least a portion and preferably all, of water zone 15*a*.

Various methods may be utilized to determine when barrier fluid pill 60 is in the desired position. Such methods are well known in the art, but may include, for example, injectable tracer fluid or trackers apparatuses $T_1$, $T_2$, $T_3$, $T_4$ that can injected into specific fluid 38, 42, 60, 64, and can be used to identify or distinguish between fluids 38, 42, 60, 64 within the wellbore 10. In one or more embodiments, at least one, and preferably a plurality of spaced apart sensors 74 may be deployed along the drillstring 24. Sensors 74 may be utilized to identify a tracker apparatus $T_1$, $T_2$, $T_3$, $T_4$ or tracer fluid injected into the wellbore 10. In one or more embodiments, sensors 74 may be RFID sensors disposed to identify RFID tracker apparatuses $T_1$, $T_2$, $T_3$, $T_4$ carried by a fluid 38, 42, 60, 64 within the wellbore 10. In one or more embodiments, sensors 74 may be optical or chemical sensors disposed to identify chemical tracker apparatuses $T_1$, $T_2$, $T_3$, $T_4$ carried by a fluid 38, 42, 60, 64 within the wellbore 10. Such tracker apparatus $T_1$, $T_2$, $T_3$, $T_4$ or tracer fluid may be injected ahead of barrier fluid pill 60 or included in barrier fluid pill 60. Alternatively, a sensor 74 may be configured to identify a component within the barrier fluid pill 60, thereby allowing the movement of barrier fluid pill 60 upwards through annulus 26 to be monitored and controlled. In one or more embodiments, sensor and instrumentation module 54 may also include sensors for identifying the presence of barrier fluid pill 60.

In any event, in one or more embodiments, barrier fluid pill 60 is placed upstream or "up wellbore" from first vertical depth $VD_1$. When so positioned, conformance fluid 64 is positioned in the wellbore annulus 26 to be adjacent water zone 15*a*. Preferably conformance fluid 64 overlays all or at least a portion of water zone 15*a*. It will be appreciated that when the physical position and characteristics of water zone 15*a* is determined within formation 14, then an appropriate volume of conformance fluid 64 may be calculated and deployed to ensure that sufficient conformance fluid 64 is deployed to be adjacent the entire vertical depth of water zone 15*a*. Thus, in one or more embodiments, it is desirable to ensure that a sufficient volume of conformance fluid 64 is injected to extend at least a small vertical distance above and below vertical depths $VD_1$ and $VD_2$, respectively.

When so positioned, conformance fluid 64 may be utilized to at least partially seal or plug water zone 15*a* to inhibit the migration of water 66 from water zone 15*a* into return drilling fluid mixture 42. As stated above, the disclosure is not limited to a particular type of conformance fluid 64 or a particular method for setting, activating, hardening or otherwise causing conformance fluid 64 to seal water zone 15*a*. However, in one or more embodiments, surface back-pressure may be applied when the conformance fluid 64 is positioned to force at least a portion of the conformance fluid 64 into the water zone 15*a*. For example, the pressures P1 and P2 may be increased to force or drive conformance fluid 64 into the water zone 15*a* adjacent wellbore 10. The pressure P1 may be increased by fluid management control system 70 slowly pumping down the drillstring 24, and the pressure P2 may be increased by bullheading down the wellbore annulus 26 with pressure control mechanism 32. In some embodiments, while increasing the pressures P1 and P2 to drive conformance fluid 64 into the water zone 15*a*, the pressures P1 and P2 are maintained in a balanced relation to one another, e.g., P1 and P2 may be maintained at approximately equal values as they are increased.

It will be appreciated that barrier fluid pill 60 forms a fluid barrier that inhibits the flow of conformance fluid 64 therethrough. As such, barrier fluid pill 60 contains conformance fluid 64 in a region adjacent water zone 15*a* as the conformance fluid 64 is being set or otherwise engaged with water zone 15*a*. In other embodiments, other types of temporary sealing mechanisms (not shown) may be employed to inhibit flow of conformance fluid 64 therepast in the wellbore annulus 26. For example, the temporary sealing mechanism may include inflatable packers, reverse circulation subs or other wellbore devices recognized by those skilled in the art.

Once the conformance fluid 64 has sealed or plugged a water zone 15*a* as desired, pressure P2 may be decreased relative to the pressure P1 to induce the barrier fluid pill 60 to shear. Circulation of return drilling fluid mixture 42 through the barrier fluid pill 60 up and out of wellbore 10 is thereby permitted, and drilling may be resumed once the barrier fluid pill 60 is sheared.

As indicated above, the disclosure is not limited to a particular type of drilling system 20 and therefore, includes land-based drilling rigs as well as offshore platforms, semi-submersible, drill ships and any other drilling system satisfactory for forming a wellbore extending through one or more downhole formations. Likewise, the disclosure is not limited to a particular type of wellbore 10, and may be used in both substantially vertical wellbores, as well as deviated wellbores.

The term "pill" as used herein refers to a batch of specialized fluids used to form a barrier above the water producing zone 15*a* and the conformance fluids 64. Likewise, "conformance fluids" refer to any gelants, foams, precipitates, or other chemicals that can be deployed in a wellbore to partially or fully plug or seal the walls of the wellbore 10 in water zones 15*a* along the wellbore 10 in order to control the production of water 66.

2. Exemplary Operational Procedure

Figure 5:
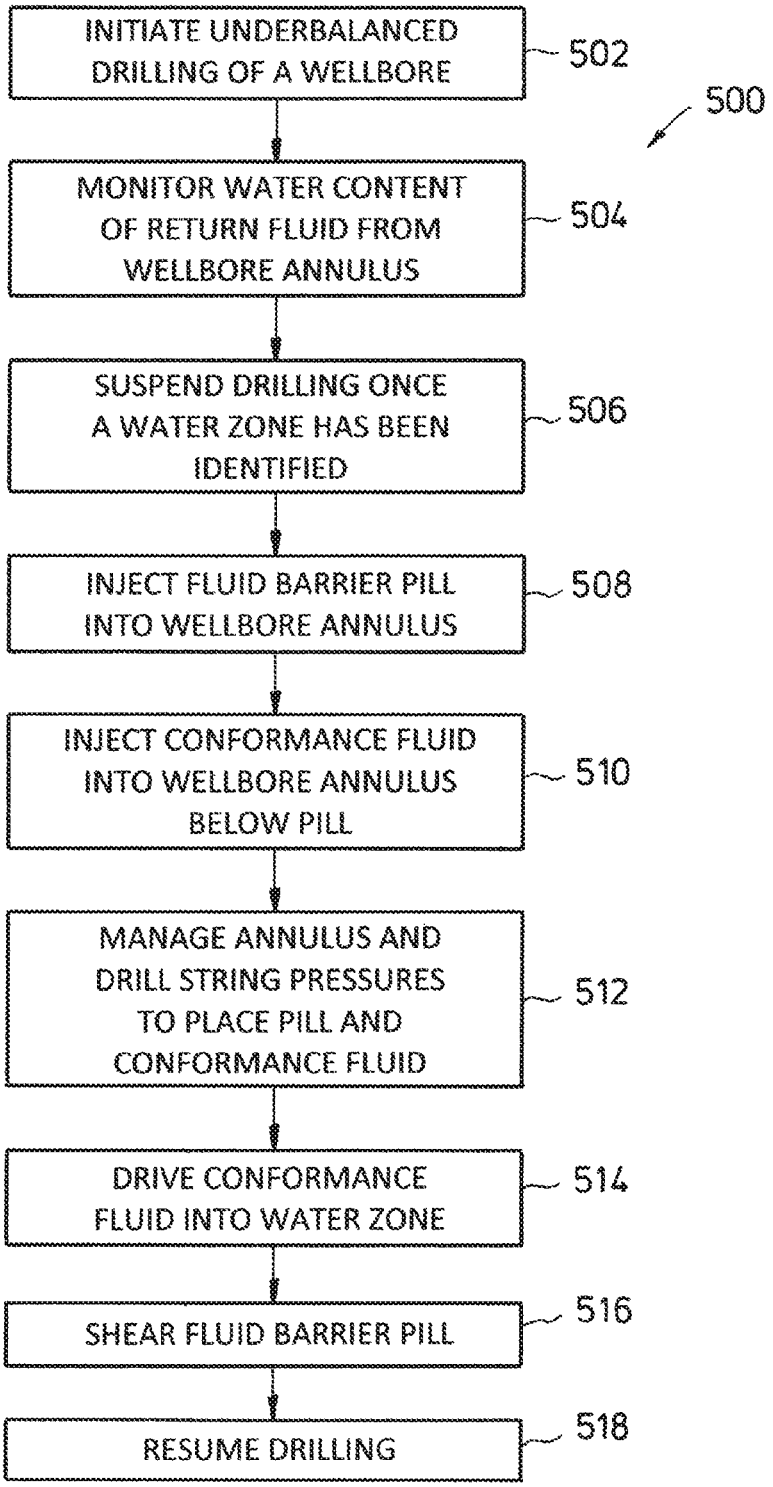
FIG. 5 is a flowchart illustrating the steps of an operational procedure for water zone identification and treatment during underbalanced drilling operations in accordance with one or more exemplary embodiments of the disclosure.

With reference to FIG. 5 therefore, and with continued reference to FIGS. 1 and 2, method 500 for underbalanced drilling operations 500 is illustrated wherein a wellbore 10 is drilled into a formation 14 having one or more formation fluid zones 15, and in particular, water zones 15*a*. In step 502, underbalanced drilling of a wellbore 10 is initiated. Underbalanced drilling may be performed by any drilling system 20 wherein the pressure P2 of return drilling fluid mixture 42 within a wellbore annulus 26 is generally maintained at a higher level than the pressure in the geologic formation 14. In one or more embodiments, the underbalanced drilling operations utilize drill pipe as the drillstring 24, and a rotating control device 32A (see FIG. 3) is provided atop a BOP 28 as part of a pressure control mechanism 32. In one or more embodiments, the underbalanced drilling operations utilize coiled tubing as the drillstring 24, and an injector head (see FIG. 4) is provided atop a BOP 28 as part of the pressure control mechanism 32 for controlling the pressure P2 of return drilling fluid mixture 42.

In step 504, as the wellbore 10 is being drilled, the return drilling fluid mixture 42 is monitored. In particular, the water cut of the return drilling fluid mixture 42 is monitored in real time or near real time to identify the first vertical depth $VD_1$ at which the drill bit 34 encounters an upper boundary of a water zone 15*a*. When a water zone 15*a* is encountered, the cut of water 66 in the return drilling fluid mixture 42 will increase as water 66 flows from the higher pressure formation 14 into the lower pressure wellbore annulus 26. Thereafter, drilling is continued until the lower boundary of the water zone 15*a* at the second vertical depth $VD_2$ is encountered. Persons of ordinary skill in the art will appreciate that when a water zone 15*a* is encountered, continued drilling of the wellbore 10 through the water zone 15*a* will result in an increase in the water cut of the return drilling fluid mixture 42. This water cut will continue to increase until the lower boundary of the water zone 15*a* is reached at second vertical depth $VD_2$, at which point, the change (A) in the water cut will substantially stabilize or even begin to decrease as other formation fluids from the formation 14 such as hydrocarbons, begin to dilute or otherwise mix with the water 66 from the water zone 15*a*. In one or more embodiments, return drilling fluid mixture 42 may be diverted to fluid analysis system 68 or tank 44 from which samples may be taken at predetermined times once a water zone 15*a* is penetrated. A standard water cut test may then be run on the sample to monitor the water cut and any change therein.

In step 506, drilling is suspended once a water zone 15*a* has been identified and the boundaries thereof, e.g., vertical depths $VD_1$ and $VD_2$, have been determined or approximated. In one or more embodiments, once drilling is suspended, the wellbore 10 may be brought to an overbalanced state to minimize inflow of formation fluids until the next steps can be performed. In step 508, following suspension of drilling, barrier fluid pill 60 is injected into the wellbore 10. Specifically, a barrier fluid pill 60 is injected from barrier fluid pill source 58 adjacent the drilling rig 22 into the drillstring 24. The barrier fluid pill 60 travels down the drillstring 24, is ejected into the wellbore annulus 26 below the water zone 15*a*, preferably at a location adjacent or in proximity to the drill bit 34, and begins to travel back up the wellbore annulus 26. The barrier fluid pill 60 is disposed to form a fluid barrier for fluids below the barrier fluid pill 60, and when positioned, will inhibit, under select pressure conditions, select fluids below the barrier fluid pill 60 from migrating up the wellbore annulus 26.

Following injection of the barrier fluid pill 60, at step 510, a conformance fluid 64 is injected into the wellbore 10. Specifically, the conformance fluid 64 is introduced into the drillstring 24 following the barrier fluid pill 60. In this regard, in one or more embodiments, the conformance fluid 64 is injected into the drillstring 24 immediately behind the barrier fluid pill 60. The particular volume of conformance fluid 64 injected into the wellbore 10 is selected based on the size of the volume of the annulus 26 and the depth and length of the water zone 15*a*. In one or more embodiments, is preferable that the volume be sufficiently large that the conformance fluid 64 forms a column of fluid that completely, or at least substantially, overlays the water zone 15*a*. In other words, the column of conformance fluid 64, when positioned adjacent the water zone 15*a*, extends above and below the water zone 15*a*, so as to seal the full length of the water zone 15*a* as described herein. In some embodiments, the selection of the volume of conformance fluid 64 is based at least partially on a predetermined or planned amount of the conformance fluid 64 planned to be injected into the water zone 15*a*.

In step 512, the pressures P1 and P2 within the wellbore 10 are controlled to position the column of conformance fluid 64 adjacent the water zone 15*a*. Specifically, the fluid pressure P1 within the drillstring 24 and the fluid pressure P2 within the wellbore annulus 26 can be adjusted to position the barrier fluid pill 60, and thereby position the column of conformance fluid 64 below the barrier fluid pill 60. In this regard, once the barrier fluid pill 60 and column of conformance fluid 64 are injected into the drillstring 24, the pressure P1 is maintained at a level above the level of pressure P2 until the barrier fluid pill 60 is positioned in the wellbore annulus 26 at a location above the water zone 15*a*, between the well head 12 and the water zone 15*a*. Preferably, the barrier fluid pill 60 is above, but in proximity to the upper boundary ($VD_1$) of the water zone 15*a*. In one or more embodiments, once the barrier fluid pill 60 is in position, the pressures P1 and P2 within the wellbore 10 may be substantially equalized, so that fluid flow up the wellbore 10 is suspended.

With the column of conformance fluid 64 positioned as desired, the conformance fluid 64 may be allowed to set, cure or otherwise function to seal the water zone 15*a*. Prior to allowing the conformance fluid 64 to set, in one or more embodiments, pressures P1 and P2 can be controlled to "squeeze" the conformance fluid 64 into the water zone 15*a* to enhance sealing (step 514). In one or more embodiments, once the barrier fluid pill 60 is in position, surface backpressure may be applied by bull heading down the wellbore annulus 26 and by slowly pumping down the drillstring 24 such that one or both pressures P1 and P2 may be increased to squeeze or drive the conformance fluid 64 into the formation 14 forming the water zone 15*a*, and thereby plug the identified water zone 15*a*. In some embodiments, the annulus pressure P2 is maintained to be slightly more than drillstring pressure P1 to force the conformance fluid 64 into the water zone 15*a*, and in some other embodiments, the drillstring pressure P1 and the annulus pressure P2 may be maintained substantially equivalent to one another as the pressures P1 and P2 are increased to force the conformance fluid 64 into the water zone 15*a*. In any event, in such embodiments, it is desirable to "squeeze" the conformance fluids 64 into the formation 14 forming the water zone 15*a* because this minimizes the amount of conformance fluid 64 remaining in the annulus 26 that will need to be pumped back to surface 16 and captured. For example, in some cases, a cement-like substance may be used as the conformance fluid 64 and must be put in place before it sets. In these cases, it is desirable to minimize the amount of the conformance fluid 64 in the wellbore annulus 26.

Once the conformance fluid 64 has set within the water zone 15*a*, in step 516, pressure P2 may be decreased to shear the barrier fluid pill 60, and circulation of return drilling fluid mixture 42 through the barrier fluid pill 60 up and out of wellbore 10 may be resumed as described above. Drilling may be resumed at step 518 once the barrier fluid pill 60 is sheared and circulation of fluids there through is permitted.

While the reservoir evaluation equipment, e.g., fluid analysis system 68, is illustrated as being located at the surface 16, it will be appreciated that some or all of the equipment may be positioned in the wellbore 10. In one or more embodiments, a sensor, e.g., a sensor within sensor and instrumentation module 54, may be disposed in the wellbore 10 to measure the cut of water 66 in the return drilling fluid 42 adjacent the drill bit 34 or at a location along the drillstring 24. In one or more embodiments, such sensors may include integrated computational element sensors disposed to measure in-situ in real time.

While the real time conformance method and system have been described primarily in relation to water zones 15*a* within a formation 14, the foregoing may also be utilized to control fluid flow from any other fluid zones 15 within the formation 14.

Illustrative embodiments and related methodologies of the present disclosure are described below as they might be employed for in-situ wellbore formation fluid composition analysis using a thermal modulated vibrating sensing module. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings

3. Aspects of the Disclosure

The aspects of the disclosure described in this section are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a method for underbalanced drilling that includes (a) initiating underbalanced drilling of a wellbore, (b) during drilling, monitoring a characteristic of a first fluid within the wellbore, (c) upon identification of a change in the monitored characteristic, suspending drilling, (d) following suspension of drilling, placing a temporary sealing mechanism into the wellbore, (e) following placement of the temporary sealing mechanism, disposing a conformance fluid into the wellbore, and (f) controlling the pressures within the wellbore in order to position the conformance fluid adjacent a formation fluid zone through which the wellbore passes.

In some exemplary embodiments, monitoring the characteristic of the first fluid includes monitoring a content of water within the first fluid. In one or more embodiments, placing the temporary sealing mechanism into the wellbore includes placing a barrier fluid pill into the wellbore.

In another aspect, the disclosure is directed to a method for underbalanced drilling that includes (a) initiating underbalanced drilling of a wellbore, (b) circulating wellbore fluids through a drillstring and a wellbore annulus defined between the drillstring and the formation, (c) monitoring the wellbore fluids in real-time to identify formation fluid zones including water zones along the wellbore, (d) upon identification of a water zone, suspending drilling, and pumping a barrier fluid in the form of a barrier fluid pill through the drillstring into the wellbore annulus, (e) pumping a conformance fluid into the drillstring to chase the barrier fluid pill (f) positioning the barrier fluid pill in the wellbore annulus and positioning the conformance fluid immediately below the barrier fluid pill in the wellbore annulus by controlling an annulus pressure and a drillstring pressure to thereby suspend circulation of wellbore fluids, (g) allowing the conformance fluid immediately below the barrier fluid pill to set, thereby plugging at least a portion of the identified water zone (h) upon completion of the plugging, resuming circulation of wellbore fluids in the wellbore annulus, and (i) resuming underbalanced drilling of the wellbore.

In one or more exemplary embodiments, the monitoring includes monitoring a return wellbore fluid to identify the cut of water in the return wellbore fluid. In some embodiments, the monitoring includes identifying an increase in the cut of water in the return wellbore fluid to identify the beginning of a water zone in the formation and identifying a change in the cut of water in the return wellbore fluid to identify the end of a water zone in the formation.

In some exemplary embodiments, the method further includes selecting a conformance fluid volume for injection into the wellbore based on the identified beginning and end of the water zone and a planned amount of the conformance fluid to be injected into the water zone. In one or more exemplary embodiments, controlling the pressures includes maintaining the drillstring pressure (e.g., the pressure within the drillstring) at a level higher than the annulus pressure (the pressure within the wellbore annulus) during injection of the barrier fluid pill and conformance fluid, and once the barrier fluid pill is in a desired position within the wellbore annulus, equalizing the drillstring and annulus pressures to maintain the barrier fluid pill at the desired position. In some embodiments, controlling the pressures includes adjusting at least one of the annulus pressure and the drillstring pressure to drive conformance fluids from the wellbore annulus into the formation. In some exemplary embodiments, the method further includes positioning the barrier fluid pill in the wellbore annulus at a location adjacent and above the beginning of the formation fluid zone.

In one or more exemplary embodiments, the method further includes placing the wellbore in an overbalanced condition upon suspension of drilling. In some exemplary embodiments, the method further includes, upon completion of placement of the conformance fluids, shearing the barrier fluid pill by reducing the annulus pressure.

In another aspect, the disclosure is directed to an underbalanced drilling system that includes a drilling rig disposed above a wellbore extending from the surface of a formation. A drillstring is disposed in the wellbore and extends from the drilling rig, so as to form an annulus between the formation and the drillstring. A barrier fluid pill is disposed in the annulus and forms a fluid barrier between the annulus above the barrier fluid pill and the annulus below the barrier fluid pill. A conformance fluid is disposed in the annulus below the pill adjacent a formation fluid zone, and drilling fluid is disposed in the annulus above the barrier fluid pill and below the conformance fluid.

In another aspect, the disclosure is directed to an underbalanced drilling system that includes a drilling rig disposed above a wellbore extending from the surface of a formation and a drillstring disposed in the wellbore and extending from the drilling rig, so as to form an annulus between the formation and the drillstring. A barrier fluid pill source is disposed adjacent the rig and in selective fluid communication with the drillstring and a conformance fluid source is disposed adjacent the rig and in selective fluid communication with the drillstring. The drillstring extends through a blowout preventer (BOP) disposed adjacent the drilling rig.

In one or more exemplary embodiments, the drillstring includes drill pipe, and the drilling system further includes a rotating control head positioned adjacent a BOP. In some exemplary embodiments, the BOP includes a ram-type blowout preventer and an annular blowout preventer. In some embodiments, the drilling system further includes a drillstring drive mechanism.

In some exemplary embodiments, the barrier fluid pill is positioned in the wellbore annulus above the formation fluid zone and the conformance fluid overlays at least a portion of the formation fluid zone. In some exemplary embodiment the conformance fluid overlays substantially all of the formation fluid zone. In one or more exemplary embodiments the drillstring pressure, e.g., drilling fluid pressure within the drillstring, is approximately equal to the annulus pressure, e.g., drilling fluid pressure within the wellbore annulus above barrier fluid pill. In some exemplary embodiments drillstring pressure and the annulus pressure are maintained greater than the fluid pressure of the formation at the formation fluid zone.

In one or more exemplary embodiments, the drilling system further includes a fluid analysis system in fluid communication with the wellbore annulus. In some embodiments, the fluid analysis system includes a fluid cut sensor. In some exemplary embodiments the fluid cut sensor is disposed in the wellbore, and in some exemplary embodiments, the fluid cut sensor is adjacent a drill bit carried by the drillstring. In one or more exemplary embodiments, the fluid cut sensor comprises an integrated computational element.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A method for underbalanced drilling comprising:

initiating underbalanced drilling of a wellbore through a formation;

during drilling, monitoring a characteristic of a fluid within the wellbore;

upon identification of a change in the monitored characteristic, suspending drilling;

following suspension of drilling, placing a temporary sealing mechanism into the wellbore;

following placement of the temporary sealing mechanism, disposing a conformance fluid into the wellbore; and controlling drillstring and annulus pressures within the wellbore in order to position the conformance fluid adjacent a formation fluid zone through which the wellbore passes.

2. The method of claim 1, wherein monitoring the characteristic of the fluid comprises monitoring a content of water within the fluid.

3. The method of claim 2, wherein placing a temporary sealing mechanism into the wellbore comprises placing a barrier fluid pill into the wellbore.

4. The method of claim 3, wherein controlling the pressures comprises maintaining the drillstring pressure at a level higher than the annulus pressure during injection of the barrier fluid pill and conformance fluid, and once the barrier fluid pill is in a desired position within the wellbore annulus, equalizing the drillstring and annulus pressures to maintain the barrier fluid pill at the desired position.

5. The method of claim 3, further comprising positioning the barrier fluid pill in the wellbore annulus at a location adjacent and above the beginning of the formation fluid zone.

6. The method of claim 1, wherein monitoring comprises monitoring a return wellbore fluid to identify a water cut of the return wellbore fluid.

7. The method of claim 6, wherein monitoring comprises identifying an increase in the water cut of the return wellbore fluid to identify a beginning of a water zone in the formation and identifying a change in the water cut of the return wellbore fluid to identify an end of the water zone in the formation.

8. The method of claim 7, further comprising selecting a conformance fluid volume for injection into the wellbore based on the identified beginning and end of the water zone and a planned amount of the conformance fluid to be injected into the water zone.

9. The method of claim 1, further comprising placing the wellbore in an overbalanced condition upon suspension of drilling.

10. The method of claim 1, wherein controlling the pressures comprises adjusting at least one of annulus pressure and drillstring pressure to drive conformance fluids from the wellbore annulus into the formation fluid zone.

11. The method of claim 1, further comprising, upon completion of placement of the conformance fluid, shearing the barrier fluid pill by reducing the annulus pressure.

12. A method for underbalanced drilling comprising;

initiating underbalanced drilling of a wellbore through a formation;

circulating wellbore fluids through a drillstring and a wellbore annulus defined between the drillstring and the formation;

monitoring the wellbore fluids in real-time to identify formation fluid zones including water zones along a wellbore;

upon identification of a water zone, suspending drilling, and pumping a barrier fluid in the form of a barrier fluid pill through the drillstring into a wellbore annulus defined about the drillstring;

pumping a conformance fluid into the drillstring to chase the barrier fluid pill;

positioning the barrier fluid pill in the wellbore annulus and positioning the conformance fluid immediately below the barrier fluid pill in the wellbore annulus by controlling an annulus pressure and a drillstring pressure;

allowing the conformance fluid immediately below the barrier fluid pill to set, thereby plugging at least a portion of the identified water zone;

upon completion of the plugging, continuing circulation of wellbore fluids in the wellbore annulus; and resuming underbalanced drilling of the wellbore.

13. An underbalanced drilling system comprising:

a drilling rig disposed above a wellbore extending from the surface of a formation;

a drillstring disposed in the wellbore and extending from the drilling rig, so as to form a wellbore annulus between the formation and the drillstring;

a barrier pill disposed in the wellbore annulus and forming a fluid barrier between the wellbore annulus above the pill and the wellbore annulus below the pill;

conformance fluid disposed in the wellbore annulus below the pill adjacent a formation fluid zone; and drilling fluid in the wellbore annulus above the pill and below the conformance fluid.

14. The drilling system of claim 13, wherein the drillstring comprises drill pipe, and the drilling system further comprising a rotating control head positioned adjacent a BOP.

15. The drilling system of claim 13, wherein the barrier pill is positioned in the wellbore annulus above the formation fluid zone and the conformance fluid overlays at least a portion of the formation fluid zone.

16. The drilling system of claim 15 wherein the conformance fluid overlays substantially all of the formation fluid zone.

17. The drilling system of claim 13, wherein a drillstring pressure of the drilling fluid pressure within the drillstring is approximately the same as an annulus pressure of the drilling fluid pressure within the annulus above the fluid barrier pill.

18. The drilling system of claim 13, further comprising a fluid analysis system in fluid communication with the wellbore annulus.

19. The drilling system of claim 18, wherein the fluid analysis system comprises a fluid cut sensor.

20. The drilling system of claim 19, wherein the fluid cut sensor is disposed in the wellbore.

* * * * *